United States Patent [19]

Farber et al.

[11] Patent Number: 5,038,523

[45] Date of Patent: Aug. 13, 1991

[54] SEAWATER HYDRAULIC ROTARY DISK TOOL

[75] Inventors: Bruce Farber, Oak View; Scott Barradas, Oxnard, both of Calif.; David B. Wyman, Panama City, Fla.; Wayne Tausig, Oxnard, Calif.; Donald W. Caudy, Sunbury, Ohio; Donald J. Hackman, Columbus, Ohio; John R. Myers, Columbus, Ohio; William R. Dick, Columbus, Ohio

[73] Assignee: The United States of America as represented by the Secretary of the Navy, Washington, D.C.

[21] Appl. No.: 520,473

[22] Filed: May 8, 1990

[51] Int. Cl.[5] ..... B24B 23/02

[52] U.S. Cl. ..... 51/170 R; 51/180; 15/1.7

[58] Field of Search ..... 51/170 R, 170 T, 180; 15/1.7, 385, 387, 383

[56] References Cited

U.S. PATENT DOCUMENTS

| | | | |
|---|---|---|---|
| 2,077,693 | 4/1937 | Herrero . | |
| 3,899,852 | 8/1975 | Batson . | |
| 3,906,682 | 9/1975 | Glasser | 51/170 T |
| 3,928,947 | 12/1975 | Millett | 51/170 T |
| 4,102,084 | 7/1978 | Bloomquist . | |
| 4,129,966 | 12/1978 | Smart et al. . | |
| 4,193,228 | 3/1980 | Bowler . | |
| 4,380,270 | 4/1983 | Ludwig . | |
| 4,463,525 | 8/1984 | Sheber | 51/170 R |

FOREIGN PATENT DOCUMENTS

| | | | |
|---|---|---|---|
| 2581911 | 11/1986 | France | 51/170 T |

*Primary Examiner*—Roscoe V. Parker
*Attorney, Agent, or Firm*—David S. Kalmbaugh

[57] ABSTRACT

This invention pertains to a rotary disk tool which utilizes pressurized seawater as the working fluid. When an operator engages a trigger on a novel control handle and valve assembly, pressurized seawater enters the rotary disk tool through the control handle and valve assembly into a seawater powered vane motor. The shaft of the seawater powered vane motor, is coupled to a drive gear. The drive gear, in turn, is in operative engagement with a driven pinion coupled to an output shaft which drives an abrasive disk. Seawater exhausted from the motor into a gear and pinion housing provides lubrication for the drive gear, driven pinion, and the bearings used with the gear and pinion. The seawater is then exhausted from the housing as a fan spray directed onto the back of the abrasive disk so as to reduce drag of the disk in water and to flush away loose material from the work surface.

19 Claims, 5 Drawing Sheets

SEAWATER HYDRAULIC ROTARY DISK TOOL

BACKGROUND OF THE INVENTION

1. Field of the Invention

This invention relates generally to seawater powered tools. In particular, this invention relates to a rotary disk tool which utilizes pressurized seawater as the hydraulic operating fluid.

2. Description of the Prior Art

Conventional underwater tools are underwater pneumatic tools, underwater oil hydraulic tools and underwater electric tools which respectively utilize pressurized air, pressurized oil and electric power for motive power. Such conventional underwater tools have certain disadvantages.

In the underwater pneumatic tools, the air is usually exhausted into the surrounding water so that the depth at which the underwater pneumatic tool can be used is limited due to back pressure on the discharged air. Moreover, large quantities of bubbles are generated so that visibility in the water is disturbed and in some cases, the use of acoustic communication through the water is disturbed.

The use of oil driven hydraulic tools underwater creates serious logistics problems in that large quantities of oil have to be shipped and stored at sea. There is also a need for supply and return hoses from a surface ship limiting the diver's ability to handle the hydraulic tool, particularly where surge and strong currents exist. Further, leakage of the oil fluid from the tool would contaminate the environment.

In underwater electric tools, electrical leakage into the water can occur so that it is dangerous for the diver to operate the tool underwater.

Another alternative would be to design a hydraulic tool which utilizes pressurized seawater as the operating fluid. The design of a tool which utilizes seawater as the hydraulic fluid presents a serious challenge to the designer because of the general corrosiveness of seawater on precision made parts in such tools. The poor lubricity of seawater and much lower viscosity for seawater than for conventional oil hydraulic fluid contributes to the problem of designing an efficient seawater operated hydraulic tool.

With the disadvantages inherent in the design of oil operated tools, air operated tools and electrically powered tools when utilized in an underwater environment, the present invention was conceived and one of its objectives is to provide a rotary disk tool for use in an underwater environment, which utilizes seawater as the operating fluid and provides satisfactory results for the user.

It is another object of the present invention to provide a rotary disk tool which utilizes seawater as the hydraulic fluid so as not to contaminate the environment.

Various other advantages and objectives of the present invention will become apparent to those skilled in the art as a more detailed description of the invention is set forth

SUMMARY OF THE INVENTION

The aforesaid and other objects of the invention are accomplished by a rotary disk tool which utilizes pressurized seawater as the working fluid. When an operator engages a trigger on a novel control handle and valve assembly, pressurized seawater enters the rotary disk tool through the control handle and valve assembly into a seawater powered vane motor. The shaft of the seawater powered vane motor, is coupled to a drive gear. The drive ear, in turn, is in operative engagement with a driven pinion coupled to an output shaft which drives an abrasive disk. Seawater exhausted from the motor into a gear and pinion housing provides lubrication for the drive gear, driven pinion, and the bearings used with the gear and pinion. The seawater is then exhausted from the housing as a fan spray directed onto the back of the abrasive disk so as to reduce drag of the disk when the disk engages the work face and to flush away loose material from the work surface.

DETAILED DESCRIPTION OF THE PREFERRED EMBODIMENT

Figure 1:
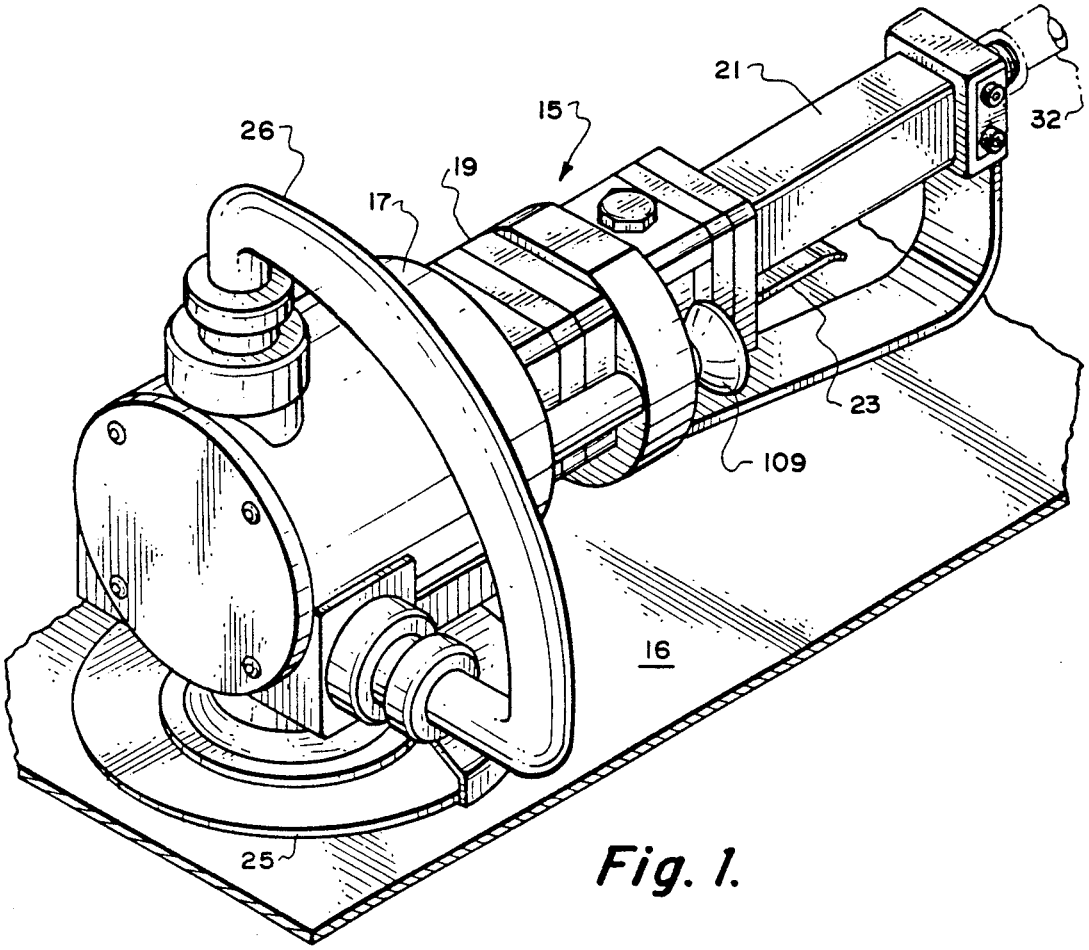
FIG. 1 is a perspective view of the seawater powered rotary disk tool constituting the present invention.
Figure 2:
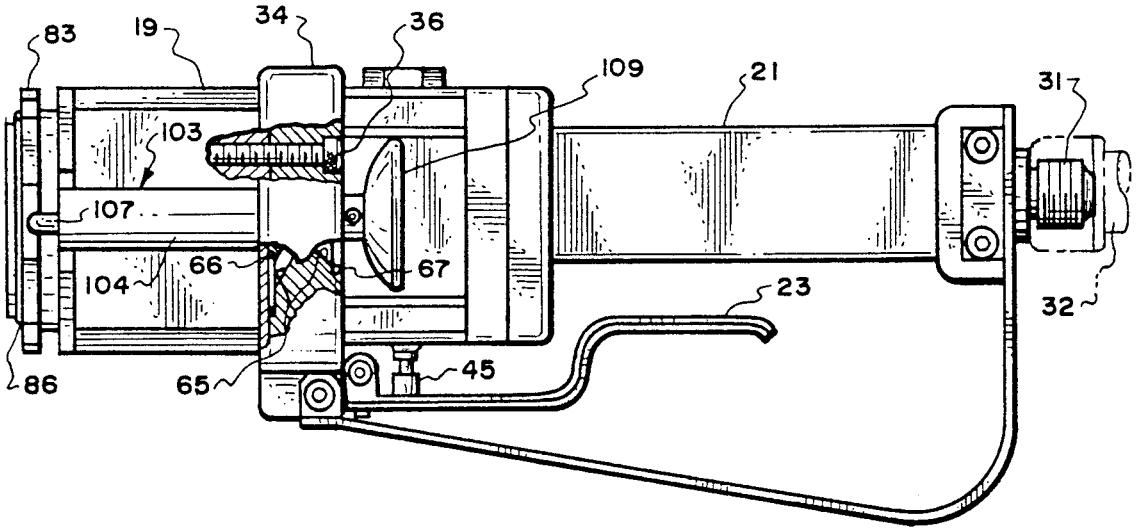
FIG. 2 is a side view illustrating the control handle and valve assembly and the locking rod assembly of the present invention.

The preferred embodiment of the seawater hydraulic rotary disk tool constituting the present invention will now be discussed in some detail in conjunction with all of the figures of the drawing.

Referring first to FIG. 1 there is shown a perspective view of a seawater hydraulic rotary disk tool 15 which may be used to grind or cut a work piece surface 16 and which comprises a gear and pinion housing 17 having rotatably mounted thereon a seawater powered vane motor 19. Attached to motor 19 is a control handle and valve assembly 21 which includes a trigger 23 which when engaged by an operator allows pressurized seawater to enter motor 19 thereby activating motor 19. Activating motor 19 translates rotary motion to an abrasive saw/grinding disk tool 25 which is connected to tool 15 and which may be removed therefrom. While FIG. 1 illustrates tool 15 being used as a grinder, tool 15 is also adapted for use as a cutting tool and has successfully cut 1 inch rebar, $1\frac{1}{4}$ synthetic line, $\frac{5}{8}$ inch bolts and 1 inch wire rope. Rotary disk tool 15 also includes a handle 26, the ends of which are threadably connected to housing 17 to allow for its removal so that handle 26 by be used by either a right handed operator as illustrated in FIG. 1 or a left handed operator.

At this time it should be noted that vane motor 19 is a reversible vane type 3.5 horsepower hydraulic motor which is operable with seawater as the hydraulic fluid and is described in U.S. Pat. No. 4,376,620, issued Sept. 8, 1983 to John R. Colston.

Referring now to FIGS. 2, 3, 4 and 5 pressurized seawater to drive motor 19 is provided by a source, not shown, through a threaded inlet 31 connected to a supply hose 32, illustrated in phantom, and a passageway 33 to the inlet side of valve assembly 39 within control handle assembly 21. Control handle assembly 21 is attached to a motor/valve interface plate 34 by bolts 35, which is, in turn, attached to motor 19 by bolts 36. Valve assembly 39 includes a valve 41 which has a stem 42 that is slidingly fitted in a cavity 43 within control handle assembly 21. There is attached to the front end of stem 42 a trigger pin 45 which is, in turn, connected to trigger 23 which is rotatably connected to control handle assembly 19.

Stem 42 also has a cavity 51 at its rear end, and a conical shaped face 53 near its center which is held against a valve seat 55 by a spring 57. Positioned on the underside of valve seat 55 within cavity 43 is an O ring 58 which allows movement of seat 55 with respect to conical shaped face 53, thereby assuring that conical shaped face 53 will seal against valve seat 55. Spring 57 has one end mounted within cavity 51 and the opposite end abutting a spring cap 59 mounted within the gear portion of cavity 43. A seal 61 positioned between the inner surface of spring cap 59 and stem 42 prevents leakage of pressurized seawater into cavity 51.

Adjacent conical shaped face 53 is an indent 63 in stem 42 which provides a fluid flow path between the inlet and outlet sides of a valve assembly 39. When an operator engages trigger 23 which releases conical shaped face 53 from valve seat 55, pressurized seawater will flow from passageway 33 through an opening 62 in spring cap 59 and through indent 63 to a passageway 65 which connects the outlet side of valve assembly 39 to the inlet port of seawater powered vane motor 19. It should be noted that passageway 65 includes O rings 66 and 67 which seal passageway 65 to the outlet side of valve 39 and the inlet port of motor 19.

There is mounted around an indent 68 near the front end of stem 42 a seal 69 which is secured by a retaining sleeve 71 and which prevents leakage of pressurized seawater from cavity 43. A retaining ring 74 is utilized to secure the stem 42 of valve 41 within cavity 43.

At this time it should be noted that the critical components of valve assembly 39, valve stem 42 and valve seat 55 were fabricated from materials resistant to the corrosive effects of seawater. Specifically, valve stem 42 was fabricated from stainless steel and valve seat 55 was fabricated from Torlon, a polymer manufactured by Amoco Chemical Corporation.

Figure 8:
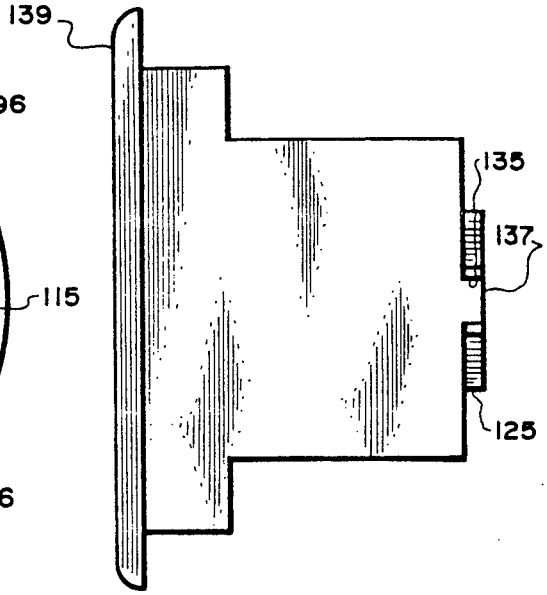
FIG. 8 is a side view of the end cap of the present invention.

Referring now to FIGS. 2, 3, 5, 6, and 7, seawater powered vane motor 19 has attached to the front end thereof by screws 81, a motor/housing interface plate 83 which has a cylindrical shaped opening 84 and is in rotational engagement with a receiving plate 85 affixed to housing 17 by screws 89. Receiving plate 85 has on an inner cylindrical surface 91 thereof four indents 92, 93, 94, and 95 which are spaced 90 degrees apart and four screw holes 96 adapted to receive screws 89. Similarly, motor interface plate 83 has on an outer cylindrical surface 97 thereof four locking tabs/members 98, 99, 100, and 101 spaced 90 degrees apart and shaped respectively the same as indents 92, 93, 94 and 95 and which when aligned respectively with indents 92, 93, 94 and 95 allow for the insertion of the front portion of motor interface plate 83 within receiving plate 85, as is best illustrated in FIG. 8, as well as the removal of motor interface plate 83 from receiving plate 85. One advantage of the motor/housing interface plate 83 is that it allows the operator to quickly remove the gear and pinion housing 17 from the motor assembly 19. The diver can then insert any other tool housing (such as a drill oz impact wrench assembly) having a similar receiving plate, and mate it to the motor assembly of the present invention. Motor interface plate 83 also has four screw holes 102 adapted to receive screws 81. It should be noted that motor/housing interface plate 83 includes an O ring 86 which seals interface plate 83 to housing 17 thereby preventing the leakage of pressurized seawater through the seal.

Figure 3:
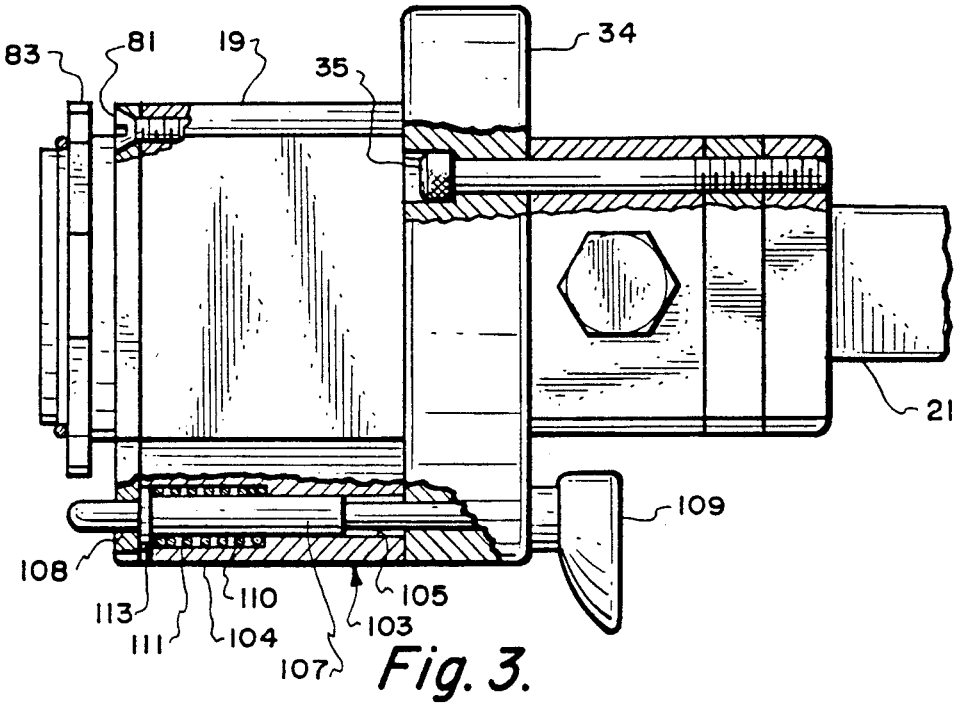
FIG. 3 is a top view of the locking rod assembly of the present invention.
Figure 4:
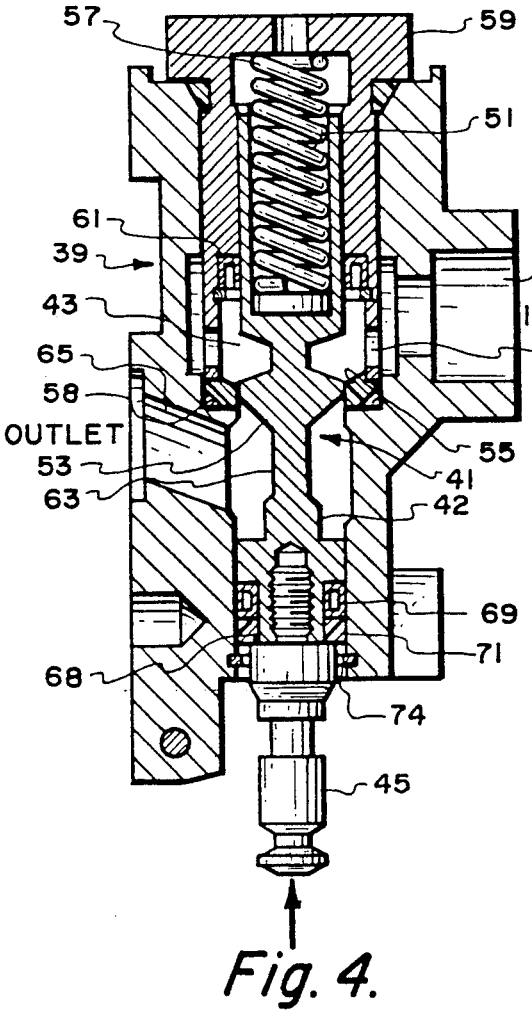
FIG. 4 is a view in section illustrating the valve assembly of the present invention.
Figure 5:
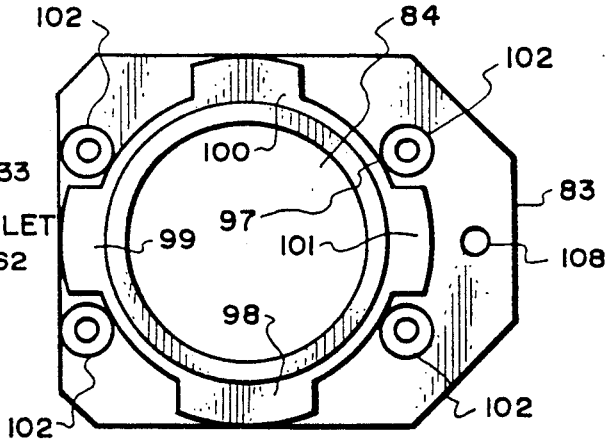
FIG. 5 is an end view of the motor/housing interface plate of the present invention.

Referring now to FIGS. 3 and 5 there is shown a locking rod assembly 103 which includes a locking rod housing 104 mounted on motor 19. Slidingly fitted in a cavity 105 located within housing 104 and interface plate 34 is a locking rod 107. Locking rod 107, in turn, has attached to the rear end thereof a handle 109, while the front end of locking rod 107 extends from interface plate 83 through an aperture 108 located therein. Tension is maintained on locking rod 107 by a spring 110 mounted in an enlarged region 111 located in the front portion of cavity 105. Spring 110, in turn, is positioned about the periphery of locking rod 107 between a flange 113 on locking rod 107 and the rear end of enlarged region 111.

Figure 6:
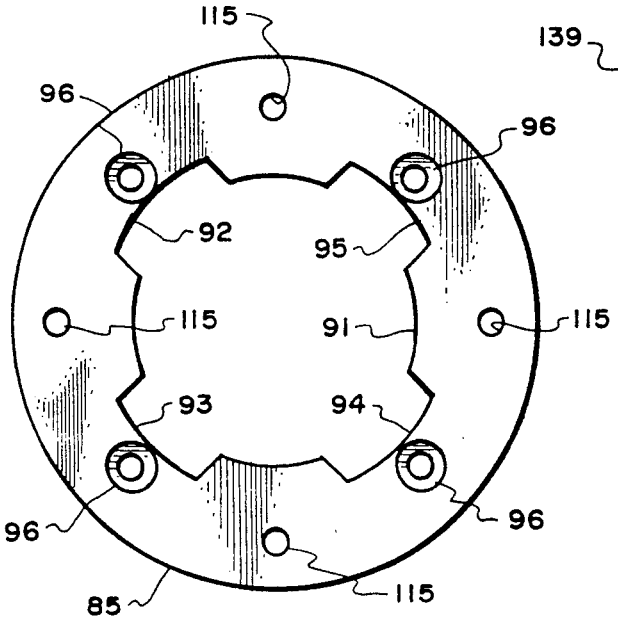
FIG. 6 is an end view of the receiving plate of the present invention.

Referring now to FIGS. 3 and 6 locking rod 107 engages one of four apertures 115, each of which is spaced 45 degrees respectively from the center line of one of the four locking tabs. By engaging one of the four apertures 115 locking rod 107 holds motor/housing interface plate 83 in a fixed position relative to receiving plate 85, and thus holds seawater powered vane motor 19 and handle 21 in a fixed position relative to housing 17. Pulling handle 109 in a rearward direction allows an operator to disengage locking rod 107 from receiving plate 85. The operator may next rotate motor 19 and handle 21 in either a clockwise or counter-clockwise direction, position handle 21 for use by either a right handed or left handed operator, and then release handle 109 allowing locking rod 107 to move in a forward direction and reengage another of the apertures 115 on receiving plate 85, thus holding handle 21 in a fixed position relative to housing 17.

Figure 7:
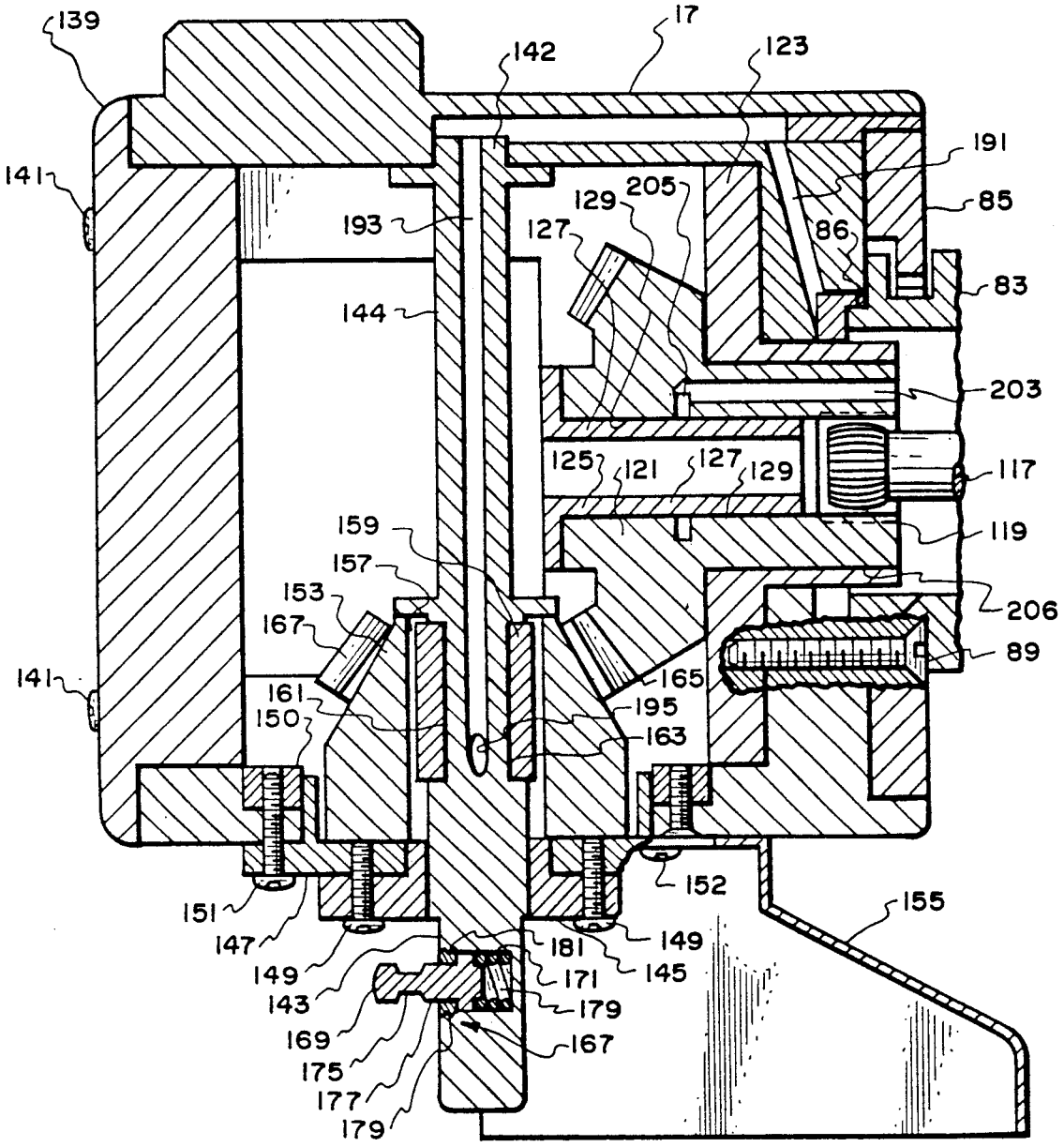
FIG. 7 is a view in section of the gear and pinion housing of the present invention.

Referring now to FIG. 7, seawater powered vane motor 19, FIG. 1, has a shaft 117 journaled in housing 17. Shaft 17, in turn, has a spherical shaped spline 119 which is coupled to and may be removed from a drive gear 121. Drive gear 121 is Journaled within a drive gear bearing 123 affixed to housing 17 by screws 89 and is displaced along the same axial line as shaft 117. The spherical shaped spline 119 of shaft 117 compensates for possible non-alignment of motor shaft 117 with respect to drive gear 121 thereby preventing axial or lateral loads from being transferred to shaft 117 when rotary disk tool 15 is operational.

Figure 9:
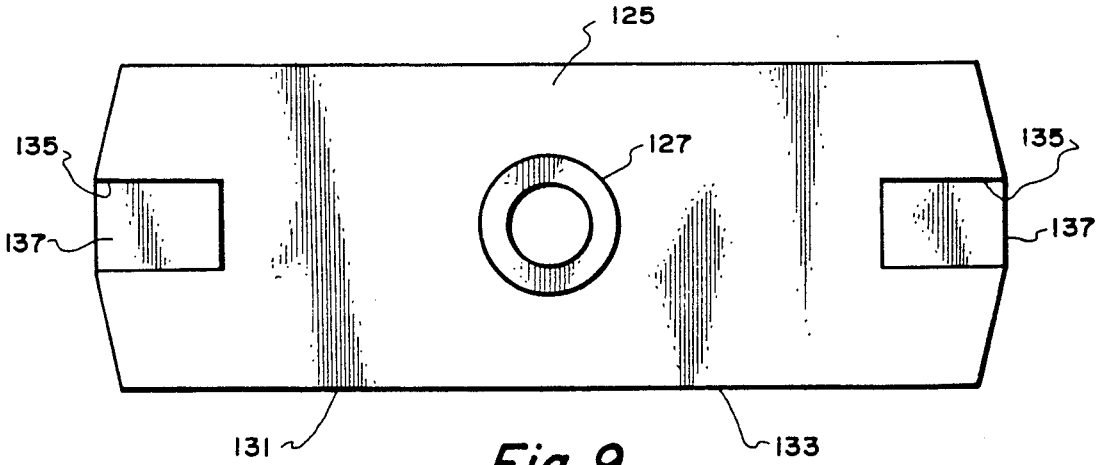
FIG. 9 is a top view of the internal drive gear bearing used in the present invention.

Referring now to FIGS. 7, 8, and 9 rotational as well as axial support for drive gear 121 is provided by drive gear bearing 123 and an internal drive gear bearing 125. Drive gear bearing 125 has an elongated portion 127 positioned within a bore 129 in drive gear 121 and a pair of arms 131 and 133. Each arm has at the end thereof an indent 135 which engages a tab 137 extending from an end cap 139. End cap 139, in turn, is connected to the left side of housing 17 by screws 141, as viewed in FIG. 8. End cap 139 also supports drive gear bearing 125 in a fixed positioned and is an integral component of housing 17.

Referring now to FIG. 7, there is rotatably mounted within housing 17 a driven shaft 144 the axial line of which is perpendicular to the axial line of drive gear 121. Shaft 144 has the upper end thereof rotatably supported by an cylindrical shaped opening 142 in housing 17 while the square shaped lower end portion 143 of shaft 144 extends outwardly from housing 17 through a shaft bearing 145, which provides rotational support for the lower end of shaft 144. Shaft bearing 145 is connected to a thrust collar 147 by screws 149, while thrust collar 147 is connected to housing 17 and a thrust collar back up ring 150 by screws 151. Thrust collar back up ring 150, which is fabricated from stainless steel, is used to insure that thrust collar 147 remains secured to housing 17, which is fabricated from Delrin, during the operation of rotary disk tool 15. Delrin is a noncorrosive acetal resin manufactured by E. I. Dupont which may yield at treaded connections when subjected to forces similar to the thrust loads exerted by a driven pinion 153 on thrust collar 147 during the operation of tool 15. Screws 152 secure to housing 17 a semicircular shaped disk guard 155 which prevents injury of an operator by debris when rotary disk tool 15 is operational.

Driven pinion 153 is affixed to driven shaft 144 by a pair of keys 157 and 159 respectively seated within keyways 161 and 163. The axial line of driven pinion 153 is perpendicular to the axial line of drive gear 121. The teeth 165 of drive gear 121 mate with the teeth 167 of driven pinion 153 such that when seawater powered vane motor 19 is operational drive gear 121 will impart rotary motion on driven pinion 153 thereby rotating driven shaft 144 which has attached to the end portion 143 thereof abrasive saw/grinding disk 25, FIG. 1. Lateral support for driven shaft 144 is provided by shaft bearing 145.

There is located in the lower end portion 143 of shaft 144 outside of housing 17 a quick release tool changer assembly 167 which facilitates the changing or replacement of tools 25 to accomplish the desired cutting, grinding, or other work operation of the rotary disk tool 15. Tool changer assembly 167 includes a quick release button 169 which is slidably disposed within a boss 171 of shaft 144 and which has a minor diameter portion 175 and a major diameter portion 177 each of which extends outward from shaft 144. A spring 179 is positioned between the underside of button 169 and the bottom wall of boss 171. A retaining ring 179 mounted within annular groove 181 in boss 171 retains button 169 within boss 171.

Figure 10:
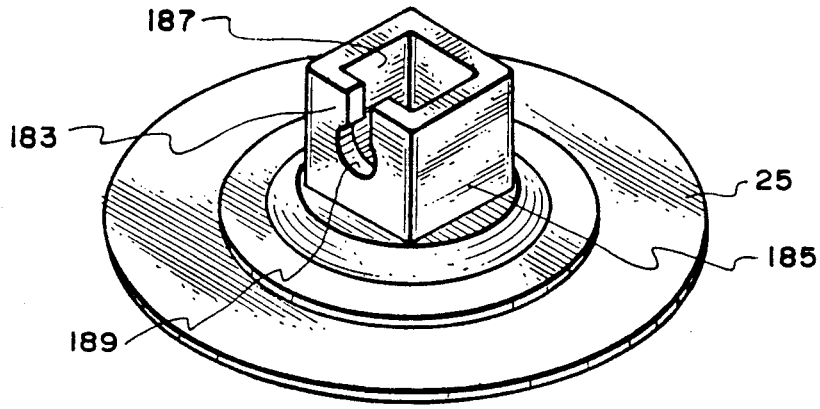
FIG. 10 is a perspective view illustrating the tool mounting element of the disk tool used with the present invention.

Referring now to FIGS. 7 and 10, when it is desired to change tool 25, an operator will depress button 169 which allows the operator to align a slot 183 in the tool mounting element 185 of tool 25 with the minor diameter portion 175 of button 169. The operator may next insert the lower portion 143 of shaft 144 within the square shaped hole 187 of tool mounting element 185 until button 169 aligns with a hole 189 located at the lower end of slot 183 and having a diameter approximately the same as the major diameter portion 177 of button 169. The operator may then release button 169 allowing the major diameter portion 177 of button 169 to engage hole 189 which secures tool 25 to shaft 144.

Figure 11:
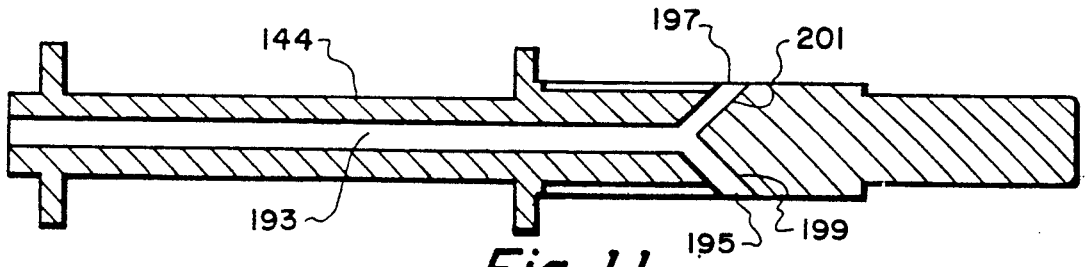
FIG. 11 is a view in section of the driven shaft of the present invention.
Figure 12:
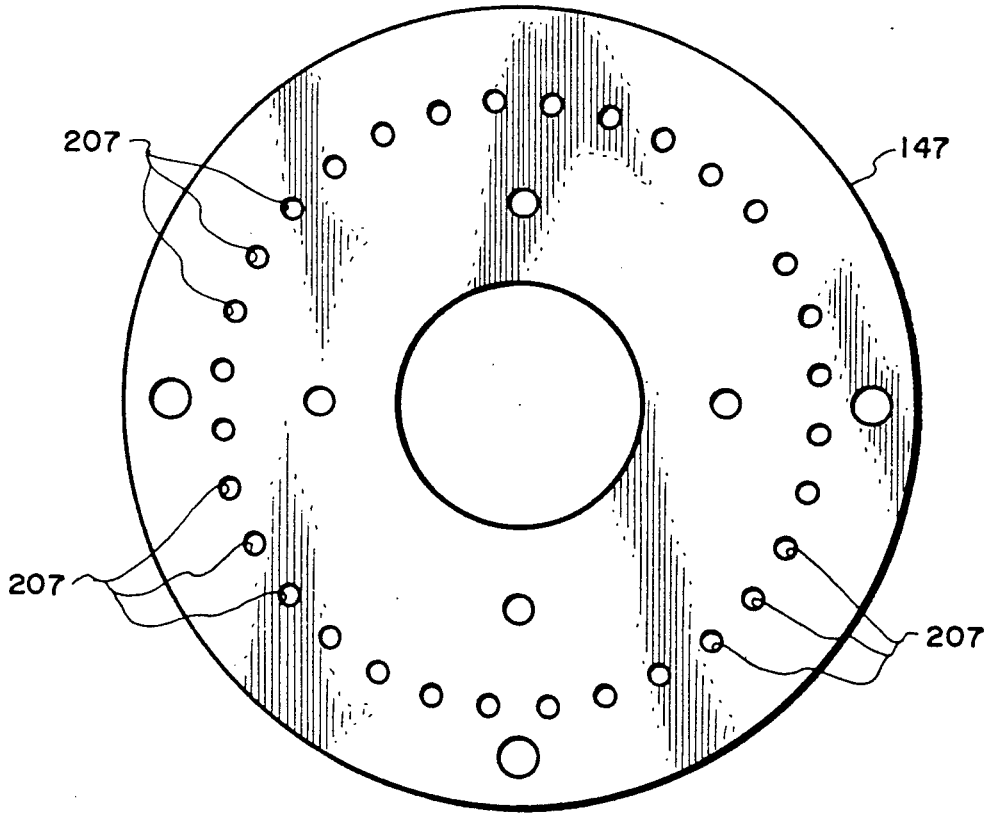
FIG. 12 is an end view of the thrust collar of the present invention.

Referring now to FIGS. 7, 11, and 12, there is shown an approximately L shaped water line 191 which extends from opening 84 in motor interface plate 83 through the upper portion of housing 17 to opening 142. Water line 191 communicates with a Y shaped water line 193 within in driven shaft 144 and provides pressurized seawater exhausted through an exhaust port, not shown, of vane motor 19 to water line 193. Pressurized seawater then exits shaft 144 through a pair of apertures 195 and 197 which communicate respectively with the arms 199 and 201 of Y shaped water line 193 to cool and lubricate driven pinion 153. There is also a water line 203 within drive gear 121 which extends from opening 84 to an aperture 205 which communicates with drive gear bearing 125. Pressurized seawater is, in turn, provided through water line 203 to lubricate and cool the bore surface 129 of drive gear 121, while pressurized seawater from opening 84 is forced between the mating surfaces of drive gear bearing 123 and drive gear 121 to lubricate and cool the outer surface 206 of drive gear 121. pressurized seawater is then exhausted from housing 17 as a fan spray through a plurality of exhaust ports 207 circularly positioned within thrust collar 147 and directed onto the back side of abrasive disk 25 with the pressurized seawater functioning as means to reduce the drag of disk 25 when disk 25 engages work surface 16 and to flush away loose material from the work surface 16 thereby removing debris from the operator's work area.

At this time it should be noted that the critical components of rotary disk tool 15 are fabricated from materials which are resistant to the corrosive effects of seawater. Drive gear 121, driven pinion 153, housing 17, shaft bearing 145 and handle 26 were fabricated from Delrin, while driven shaft 144, thrust collar 147, bearings 123 and 125, receiving plate 85 and interface plate 83 were fabricated from stainless steel.

It will of course be understood that various changes may be made in form, details, arrangement and proportions of the parts without departing from the scope of the invention herein which, generally stated, consists of an apparatus capable of carrying out the objects above set forth, in the parts and combinations of parts disclosed and defined in the appended claims.

What is claimed is:

1. A pressurized seawater powered rotary disk tool for treating a work surface and having an abrasive saw/grinding disk tool connected thereto and which may be removed therefrom, said seawater powered rotary disk tool comprising:

a gear and pinion housing;

a seawater powered vane motor rotatably mounted on said gear and pinion housing and removable from said housing, said seawater powered vane motor having a shaft journaled within said housing, an inlet port and an outlet port;

control means having a trigger and a passageway connected to the inlet port of said seawater powered vane motor, the trigger of said control means when engaged allowing pressurized seawater to pass through said control means to the inlet port of said seawater powered vane motor so as to rotate the shaft of said Vane motor;

a drive gear rotatably mounted in said housing in axial alignment with the shaft of said seawater powered vane motor, said drive gear being coupled to and removable from the shaft of seawater powered vane motor;

a driven shaft rotatably mounted in said gear and pinion housing perpendicular to the axis of said drive gear, said driven shaft having an end portion extending from said gear and pinion housing;

a driven pinion affixed to said driven shaft, said driven pinion being in operative engagement with said drive gear; and means for directing pressurized seawater exhausted from said seawater powered vane motor onto the back side of said saw/grinding disk tool so as to reduce the drag of said saw/grinding disk tool when said saw/grinding disk tool engages said work surface and to flush away loose material from said work surface.

2. The rotary disk tool of claim 1 wherein said control means comprises:

a control handle assembly attached to said vane motor and having a cavity, an inlet passageway connected to said cavity and an outlet passageway connected between said cavity and the inlet port of said vane motor;

a valve having a valve seat mounted within the cavity of said control handle assembly, a stem slidingly fitted within the cavity of said control handle assembly, and a spring;

said valve stem having a trigger pin at one end, an indent and a conical shaped face adjacent said indent with the spring of said valve being adapted to hold the conical shaped face of said valve stem against said valve seat; and a trigger rotatably connected to said control handle assembly, said trigger being connected to the trigger pin of said valve stem such that engagement of said trigger releases the conical shaped face of said valve stem from said valve seat allowing pressurized seawater to flow from the inlet passageway of said control handle assembly through the indent of said valve stem and the outlet passageway of said control handle assembly into the inlet port of said vane motor.

3. The rotary disk tool of claim 1 wherein said directing means comprises a thrust collar connected to the bottom of said gear and pinion housing and having said driven shaft extending therethrough, said thrust collar having a plurality of exhaust ports circularly positioned therein for exhausting seawater from said gear and pinion housing.

4. The rotary disk tool of claim 1 wherein the portion of said driven shaft extending from said gear and pinion housing is square shaped and is adapted to receive said abrasive saw/grinding disk tool.

5. The rotary disk tool of claim 4 wherein the square shaped portion of said driven shaft extending from said gear and pinion housing has a quick release tool changer assembly, said quick release tool changer assembly comprising:

a boss positioned within the portion of said driven shaft extending from said gear and pinion housing, said boss having an annular ring;

a quick release button slidably disposed within said boss and having a minor diameter portion and a major diameter portion each of which extends outward from said driven shaft;

a spring positioned between the underside of said quick release button and the bottom wall of said boss; and a retaining ring mounted within the annular ring of said boss.

6. The rotary disk tool of claim 1 further characterized by a Y shaped water line located within said driven shaft and an L shaped water line positioned in the portion of said gear and pinion housing, said L shaped water line having one end thereof communicating with the outlet port of said vane motor and the opposite end thereof connected to said Y shaped water line.

7. The rotary disk tool of claim 1 wherein said drive gear, said driven pinion and said gear and pinion housing are each fabricated from delrin.

8. The rotary disk tool of claim 1 wherein said driven shaft is fabricated from stainless steel.

9. The rotary disk tool of claim 1 wherein the shaft of said vane motor has a spherical shaped spline, said spherical shaped spline being adapted for coupling to said drive gear and for removal from said drive gear.

10. The rotary disk tool of claim 1 further characterized by:

a receiving plate affixed to said gear and pinion housing, said receiving plate having on an inner cylindrical surface thereof four indents spaced ninety degrees apart and four apertures, each aperture of which is spaced forty five degree from the center line of one of said four indents;

a motor/housing interface plate attached to said vane motor and having a cylindrical shaped opening and an outer cylindrical surface, said outer cylindrical surface having four locking tabs spaced ninety degrees apart and shaped respectively the same as the four indents of said receiving plate;

said four locking tabs when aligned respectively with the four indents of said receiving allowing for the insertion of the front portion of said motor interface plate within said receiving plate and for the removal of said motor interface plate from said receiving plate;

a locking rod housing mounted on said vane motor and having a cavity therein;

a locking rod slidably mounted within the cavity of said locking rod housing, said locking rod having a handle attached to the rear end thereof and having the front end thereof adapted to engage one of the four apertures of said receiving plate; and a spring mounted within the cavity of said locking rod housing, said spring being adapted to maintain tension on said locking rod.

11. A pressurized seawater powered rotary disk tool having an abrasive saw/grinding disk tool connected thereto and which may be removed therefrom, said seawater powered rotary disk tool comprising:

a gear and pinion housing;

a seawater powered vane motor rotatably mounted on said gear and pinion housing and removable from said housing, said seawater powered vane motor having a shaft Journaled within said housing, an inlet port and an outlet port;

control means having a trigger and a passageway connected to the inlet port of said seawater powered vane motor, the trigger of said control means when engaged allowing pressurized seawater to pass through said control to the inlet port of said seawater powered vane motor so as to rotate the shaft of said vane motor;

a receiving plate affixed to said gear and pinion housing, said receiving plate having on an inner cylindrical surface thereof four indents spaced ninety degrees apart;

a motor/housing interface plate attached to said vane motor and having a cylindrical shaped opening and an outer cylindrical surface, said outer cylindrical surface having four locking tabs spaced ninety degrees apart and shaped respectively the same as the four indents of said receiving plate;

said four locking tabs when aligned respectively with the four indents of said receiving allowing for the insertion of the front portion of said motor interface plate within said receiving plate and for the removal of said motor interface plate from said receiving plate;

means for locking said motor/housing interface plate in a fixed position with respect to said receiving plate;

a drive gear rotatably mounted in said housing in axial alignment with the shaft of said seawater powered vane motor, said drive gear being coupled to and removable from the shaft of said seawater powered vane motor;

a driven shaft rotatably mounted in said gear and pinion housing perpendicular to the axis of said drive gear, said driven shaft having a square shaped end portion extending from said gear and pinion housing;

means positioned in the square shaped end portion of said driven shaft for connecting said abrasive saw/-grinding disk tool to said rotary disk tool and for allowing said abrasive saw/grinding disk tool to be disconnected from said rotary disk tool;

a driven pinion affixed to said driven shaft, said driven pinion being in operative engagement with said drive gear; and means for directing pressurized seawater exhausted from said seawater powered vane motor onto the back side of said saw/grinding disk tool so as to reduce the drag of said saw/grinding disk tool when said saw/grinding disk tool engages a work surface and to flush away loose material from said work surface.

12. The rotary disk tool of claim 11 wherein said control means comprises:

a control handle assembly attached to said vane motor and having a cavity, an inlet passageway connected to said cavity and an outlet passageway connected between said cavity and the inlet port of said vane motor;

a valve having a valve seat within the cavity of said control handle assembly, a stem slidingly fitted within the cavity said control handle assembly, and a spring;

said valve stem having a trigger at one end, an indent and a conical shaped adjacent said indent with the spring of valve being adapted to hold the conical shaped of said valve stem against said valve seat;

a trigger rotatably connected t said control handle assembly, said trigger be connected to the trigger pin of said valve stem such that engagement of said trigger releases the conical shaped face of said valve stem from said valve seat allowing pressurized seawater to flow from the inlet passageway of said control handle assembly through the indent of said valve stem and the outlet passageway of said control handle assembly into the inlet port of said vane motor.

13. The rotary disk tool of claim 11-wherein said directing means comprises a thrust collar connected to the bottom of said gear and pinion housing and having said driven shaft extending therethrough, said thrust collar a plurality of exhaust ports circularly positioned therein for exhausting seawater from said gear and pinion housing.

14. The rotary disk tool of claim 11 wherein said locking means comprises:

four apertures positioned within said receiving plate, each of said apertures being spaced forty five degrees from the center line of one of said indents;

a locking rod housing mounted on said vane motor and having a cavity therein;

a locking rod slidably mounted within the cavity of said locking rod housing, said locking rod having a handle attached to the rear end thereof and having the front end thereof adapted to engage one of the four apertures of said receiving plate; and a spring mounted within the cavity of said locking rod housing, said spring being adapted to maintain tension on said locking rod.

15. The rotary disk tool of claim 11 wherein said connecting means comprises:

a boss positioned within the portion of said driven shaft extending from said gear and pinion housing, said boss having an annular ring;

a quick release button slidably disposed within said boss and having a minor diameter portion and a major diameter portion each of which extends outward from said driven shaft;

a spring positioned between the underside of said quick release button and the bottom wall of said boss;

a retaining ring mounted within the annular ring of said boss.

16. The rotary disk tool of claim 11 further characterized by a Y shaped water line located within said driven shaft and an L shaped water line positioned in the upper portion of said gear and pinion housing, said L shaped having one end thereof communicating with the outlet port of said vane motor and the opposite end thereof connected to said Y shaped water line.

17. The rotary disk tool of claim 11 wherein said drive gear, said driven pinion and said gear and pinion housing are each fabricated from delrin.

18. The rotary disk tool of claim 11 wherein said driven shaft is fabricated from stainless steel.

19. The rotary disk tool of claim 11 wherein the shaft of said vane motor has a spherical shaped spline, said spherical shaped spline being adapted for coupling to said drive gear and for removal from said drive gear.

* * * * *